United States Patent [19]

Looker

[11] Patent Number: 4,690,360

[45] Date of Patent: Sep. 1, 1987

[54] CARGO PALLET

[75] Inventor: Robert Looker, Carpenteria, Calif.

[73] Assignee: Satco, Inc., El Segundo, Calif.

[21] Appl. No.: 723,881

[22] Filed: Apr. 16, 1985

[51] Int. Cl.[4] ..... A47B 91/00

[52] U.S. Cl. ..... 248/346; 108/51.1

[58] Field of Search ..... 248/346; 52/143, 79.1; 414/12, 786; 108/51.1, 51.3, 52.1, 53.1, 53.3, 53.5, 54.1, 55.1, 56.1, 57.1

[56] References Cited

U.S. PATENT DOCUMENTS

| | | | |
|---|---|---|---|
| 2,486,284 | 10/1949 | Horwitz | 108/57.1 |
| 2,692,107 | 10/1954 | Ridder et al. | 108/51.1 |
| 2,705,120 | 3/1955 | Owen | 108/51.1 |
| 3,007,663 | 11/1961 | Huck | 108/57.1 X |
| 3,157,423 | 11/1964 | Brie | 108/51.1 X |
| 3,602,157 | 8/1971 | Cohen | 108/57.1 |
| 3,726,236 | 4/1973 | Colas | 108/51.1 |
| 4,112,854 | 9/1978 | Pitchford | 108/51.1 X |
| 4,323,016 | 4/1982 | Flesher | 108/51.1 |
| 4,347,794 | 9/1982 | Nordstrom | 108/51.1 |

FOREIGN PATENT DOCUMENTS

| | | | |
|---|---|---|---|
| 1252074 | 12/1959 | France | 108/51.1 |
| 1375229 | 11/1974 | United Kingdom | 108/51.1 |

*Primary Examiner*—J. Franklin Foss

*Attorney, Agent, or Firm*—Lyon & Lyon

[57] ABSTRACT

The cargo pallet for use in transporting cargo in aircraft, in which the balsa wood core of the prior art pallet is replaced with an aluminum grid, to which the top and bottom aluminum sheets of the pallet are attached by rivets. The aluminum grid comprises stringers and struts which may be parallel, respectively, to the sides of the pallet, or placed laterally, at an angle, respectively, to the sides of the pallet. Further, the stringers and struts may be interlocked.

9 Claims, 5 Drawing Figures

CARGO PALLET

BACKGROUND

1. Field of Invention

The invention hereinafter described and claiemd pertains to pallets upon which cargo is loaded for air transportation, and more particularly, to the manner and materials of their construction.

2. Prior Art

The prior art air cargo pallet is generally described in U.S. Specification MIL-P-27443. Basically, the prior art pallet is a piece of balsa wood, to which two aluminum sheets are laminated. The pallet of this construction weighs approximately three hundred to over a thousand pounds (depending on size) and has a service life, typically, of twelve to eighteen months. This limited service life is due to the fact that cargo, which is dropped onto the top surface of the pallet, and the forklift tines which impact the bottom surface of the pallet, cause deformation of the aluminum sheets. This deformation, in turn, causes a delamination of the bond between the aluminum sheet and the balsa wood core immediately in the area of the deformation. Then, as the pallet is used, and is subjected to lateral and other varying stresses, and, as it travels via conveyor belt and undergoes a rippling effect when it transfers from one conveyor belt to another conveyor belt at a slightly, or in some occasions, greatly, differing elevations, the delamination begins to spread.

If unnoticed, the delamination will progress to a point where there is a substantial risk of total failure of the pallet, wherein one or the other of the aluminum sheets will completely separate from the balsa wood center. As can be imagined, if that was to occuring flight, a seriously dangerous condition might result, endangering the aircraft and crew. Therefore, because it is quite difficult to constantly monitor the amount of deformation and delamination of the prior art pallet, they are regularly scrapped after twelve to eighteen months in use. As these pallets can cost at least $900 or $1,000 each, there is a substantial cost associated with the continual replacement of the prior art pallets.

There is, therefore, a need in the art for a cargo pallet with greater service life potential, such that the overall cost of use of the pallet can be reduced. However, as with any apparatus used in air transport, the divergent goals of light weight and strength are desired. Accordingly, any new cargo pallet must exhibit the light weight and strength obtained in the prior art blasa wood pallet.

SUMMARY OF THE INVENTION

The pallet of this invention accomplishes these goals in a pallet which replaces the balsa wood core of the prior art pallet with an interlocking grid of aluminum stringers and struts, to which the aluminum sheets are riveted. The resulting pallet is of equal or superior strength, lighter weight, greater resistance to deformation, lower cost and remarkably increased service life, when compared to the prior art pallet.

It is, therefore, the object of this invention to provide an improved air cargo pallet.

DETAILED DESCRIPTION OF THE PREFERRED EMBODIMENT

Except as otherwise noted, this pallet is entirely constructed of aluminum.

Figure 1:
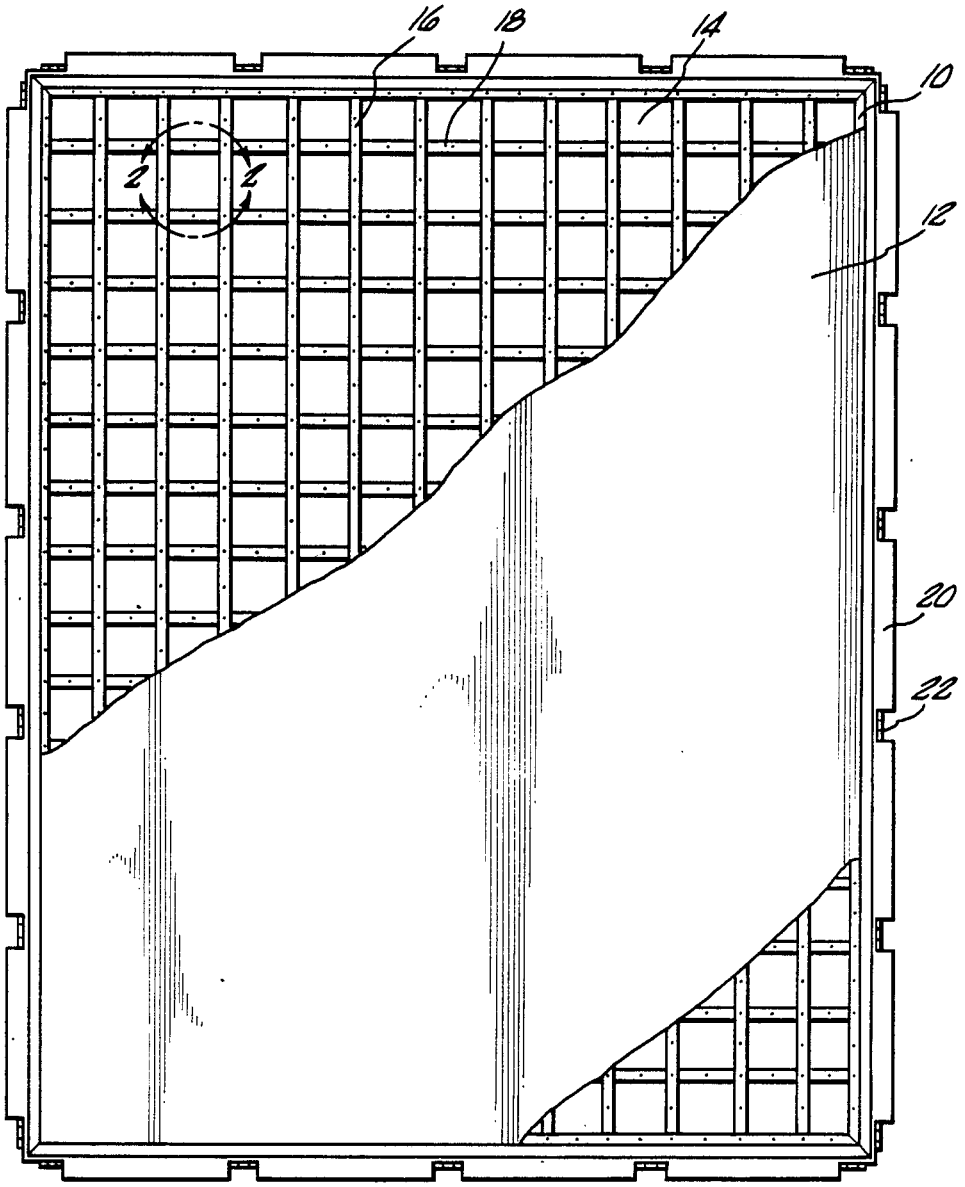
FIG. 1 is a top view of the pallet of this invention, with a portion of the top cover sheet broken away, displaying the grid of stringers and struts, in this embodiment, placed parallely to the sides of the pallet.

Looking at FIG. 1, the basic pallet is comprised of an exterior frame 10, top sheet 12, bottom sheet 14, and the core grid of stringers 16 and struts 18.

This flange 20 is used to secure the pallet in the aircraft. Attached to the frame 10 around the periphery of the pallet are hinged rings 22, which are used to secure the cargo to the pallet.

Figure 2:
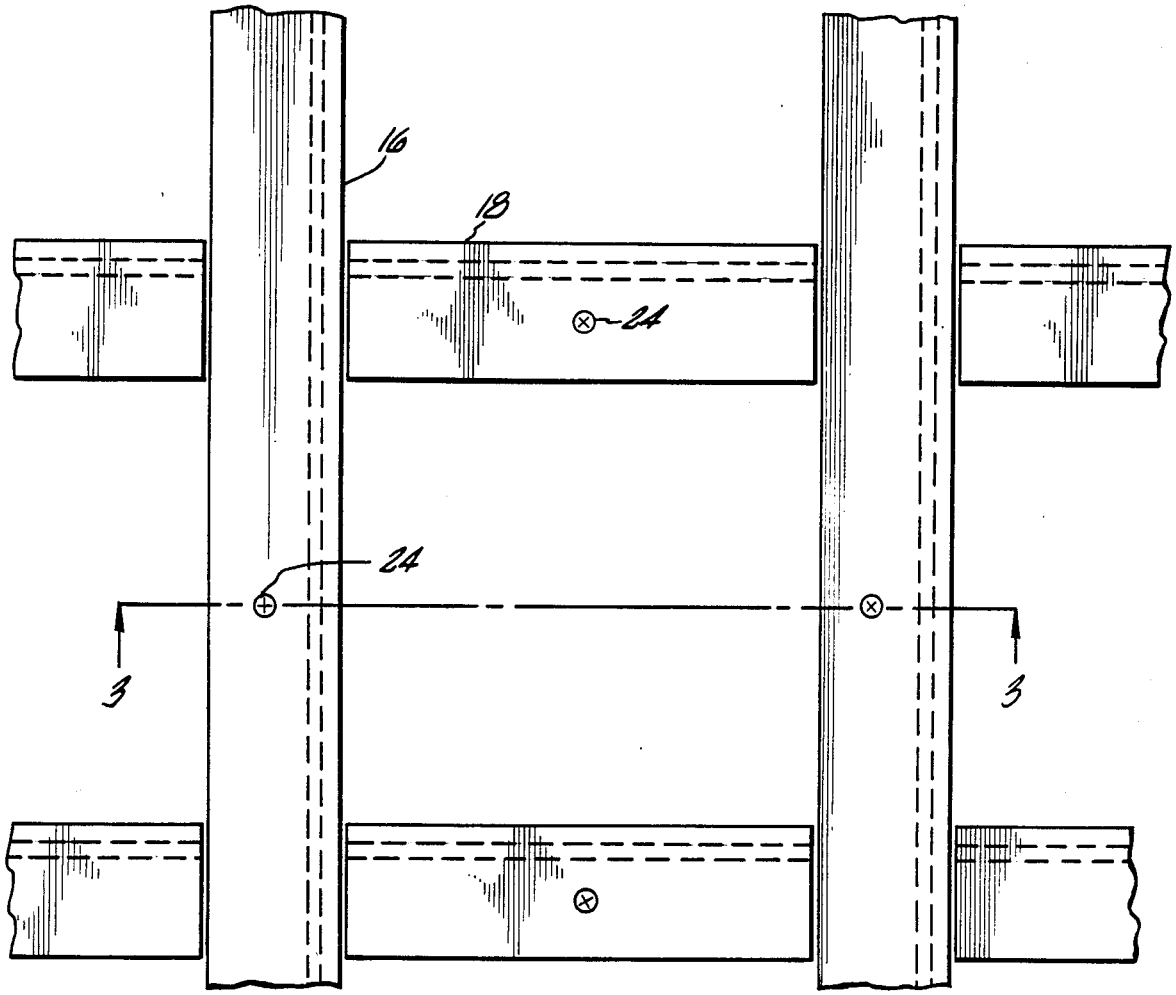
FIG. 2 is an amplified top view of that section of the stringer-strut grid taken from circle 2—2 in FIG. 1. Note that in this embodiment, the vertical stringers extend the length of the pallet, whereas the struts are interposed between the stringers.

In this embodiment, the stringers 16 and struts 18 are positioned parallelly to the respective sides of the pallet. Looking at FIG. 2, the structural relationship between stringer 16 and strut 18 can be seen. Note that the stringer 16 is not directly connected to the strut 18, and vice versa. Instead, the stringers and struts are directly connected by means of rivets 24 to the aluminum sheets 12 and 14.

Figure 3:
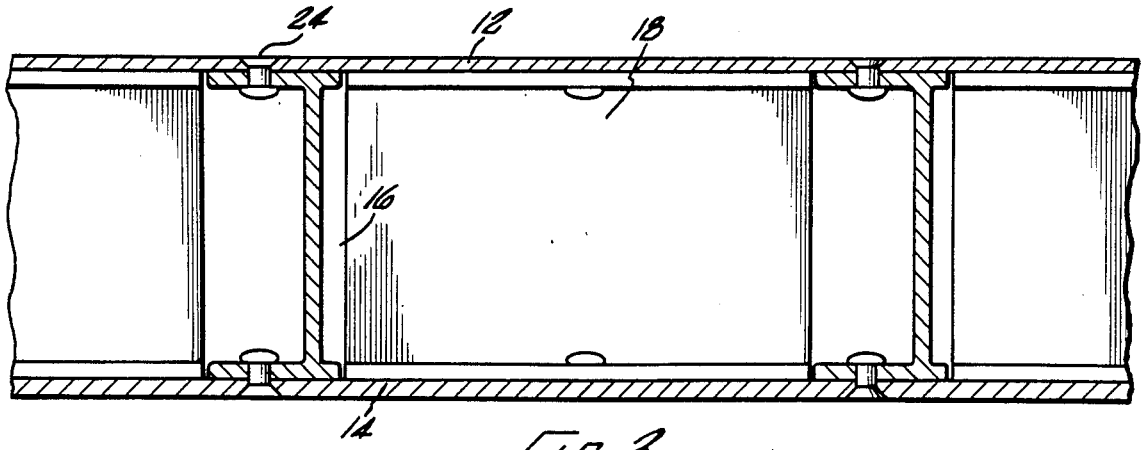
FIG. 3 is a side view of the stringer-strut grid taken along line 3—3 in FIG. 2. It shows that, in the preferred embodiment, the stringers and struts, are both C-channel aluminum bars, as well as showing the manner in which the aluminum sheets are riveted to the stringers and struts. Note also in this embodiment that the stringers and struts are not connected dirrectly together.

Looking to FIG. 3, the stringer is a C-channel bar for the best trade off of strength and lightweight.

Figure 4:
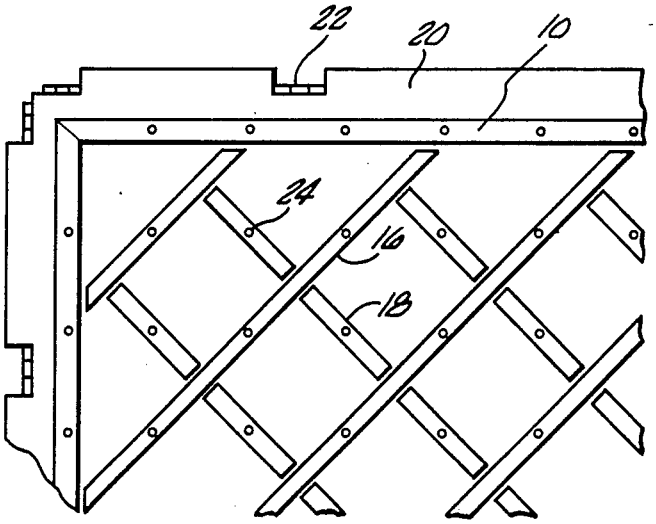
FIG. 4 shows an alternative embodiment of the invention in which the stringers and struts are placed laterally, at an angle to the sides of the pallet.

FIG. 4 shows an alternate embodiment in which the stringers 16 and struts 18 are placed at an angle to the sides of the pallet. Except for that change, the manner in which the stringers and struts are attached to the sheets 12 and 14 remain the same. In this embodiment, however, an additional benefit is obtained in that loads and stresses on the pallet, which typically are perpendicular to the sides, top and bottom of the pallet, are now shared equally by both the stringers and the struts. In the parallel orientation of the stringers and struts, this benefit is not obtained.

Figure 5:
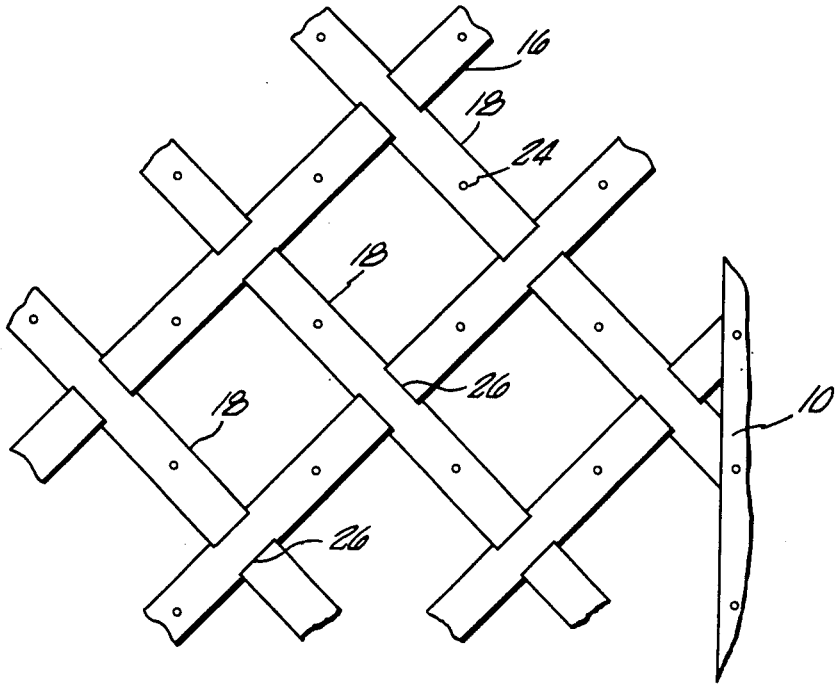
FIG. 5 is a top view of a portion of the pallet showing another embodiment in which the stringers and struts are interlocked.

FIG. 5 shows another embodiment which is intended to further more equally distribute the stresses to which the pallet may be subjected during use. In this embodiment, the stringers 16 and the struts 18 are now approximately the same size and shape, and are positioned in an interlocking grid pattern, such that the end of the stringer 16 fits into appropriately sized and shaped notches 26 on the side of the strut 18, and vice versa. Again, the top and bottom sheets 12 and 14 are attached to the stringers and struts by means of rivets 24. This embodiment is preferred by the inventor.

Although specific embodiments of this invention have been depicted and described in great detail, it would be readily apparent to those skilled in the art that other embodiments and modifications upon those described here are possible without departing from the inventive concepts to which this patent is directed. Accordingly, this patent, and the protection it provides, are not limited to any one or more of the specific embodiments herein described and depicted, but are of the full scope of the appended claims.

What is claimed is:

1. A cargo pallet comprising:

a. a rectangularly shaped core comprising a grid of a plurality of stringers and struts, said stringers and struts creating a cross-hatch assembly in which said stringers are elongate members extending from one edge of said core to the other edge of said core, and said struts are cross members between said stringers, said stringers and said struts also having at least one cross-sectional portion thereof in substantially a C-shape such that a flat surface is presented on either side thereof;

b. a first aluminum sheet rigidly attached to said flat surface on said stringers and struts on one side of said core, said first aluminum sheet sized and shaped to substantially cover said core; and c. A second aluminum sheet rigidly attached to the other said flat surface on said stringers and struts on the second side of said core, said second aluminum sheet sized and shaped to substantially cover the second side of said core.

2. The invention of claim 1 wherein said stringers and said struts are substantially perpendicular to one another.

3. The invention of claim 2 wherein said stringers and said struts are arranged substantially parallel to the respective edges of said core.

4. The invention of claim 2 wherein said stringers and said struts are at an angle to the edge of said core.

5. The invention of claim 2 wherein said first aluminum sheet and said second aluminum sheet are attached to said stringers and struts by rivet means.

6. The invention of claim 1 wherein said stringers are placed equi-distant apart from one another, and said struts are placed equi-distant apart from one another.

7. The invention of claim 1 wherein said stringers and said struts are C-channel bars.

8. The invention of claim 1 wherein said stringers have notches into which the ends of said struts are inserted.

9. In a cargo pallet having a core to which a top sheet and a bottom sheet are attached, the improvement comprising the core being constructed of a rectangular grid of C-channel stringers and struts, said stringers and struts being perpendicular to one another, and placed equi-distant apart, such that said stringers and struts form a cross hatch assembly, said stringers and struts further having a flat surface on either said thereof to which said sheets are rigidly attached by rivet means, said stringers having notches into which the ends of said struts are inserted.

* * * * *